US006932191B1

(12) United States Patent
Schwenk

(10) Patent No.: US 6,932,191 B1
(45) Date of Patent: Aug. 23, 2005

(54) ROOF SCAFFOLD SUPPORT

(76) Inventor: Kenneth G. Schwenk, P.O. Box 111, Bridgehampton, NY (US) 11932

( * ) Notice: Subject to any disclaimer, the term of this patent is extended or adjusted under 35 U.S.C. 154(b) by 2 days.

(21) Appl. No.: 10/661,956

(22) Filed: Sep. 15, 2003

(51) Int. Cl.[7] ..... E04G 5/00
(52) U.S. Cl. ..... 182/45; 248/237
(58) Field of Search ..... 182/45; 248/237

(56) References Cited

U.S. PATENT DOCUMENTS

| | | | | |
|---|---|---|---|---|
| 956,406 | A * | 4/1910 | Nowodworski | 182/45 |
| 3,425,509 | A | 2/1969 | Gilbert et al. | |
| 3,747,707 | A | 7/1973 | Fromlath et al. | |
| 4,676,341 | A | 6/1987 | Shaffstall | |
| 4,957,185 | A | 9/1990 | Courchesne et al. | |
| 4,971,169 | A | 11/1990 | Fruth | |
| 5,318,148 | A * | 6/1994 | Franco et al. | 182/45 |
| 5,862,880 | A | 1/1999 | Nelson et al. | |
| 2004/0075040 | A1 * | 4/2004 | Scallan | 249/191 |

* cited by examiner

*Primary Examiner*—Alvin Chin-Shue
(74) *Attorney, Agent, or Firm*—Donald R. Schoonover

(57) ABSTRACT

A roof scaffold support is adapted to be located on a ridge of a roof, such as a hip roof, and includes a roof-engaging base unit that has two sections that are pivotally attached to each other and which can move to accommodate the ridge of a roof. Scaffold-engaging arms are pivotally attached to the roof-engaging base unit and have crossbar elements on which scaffolding rests. A stabilizing unit is pivotally and releasably attached to the roof-engaging base unit and includes a turnbuckle element.

1 Claim, 1 Drawing Sheet

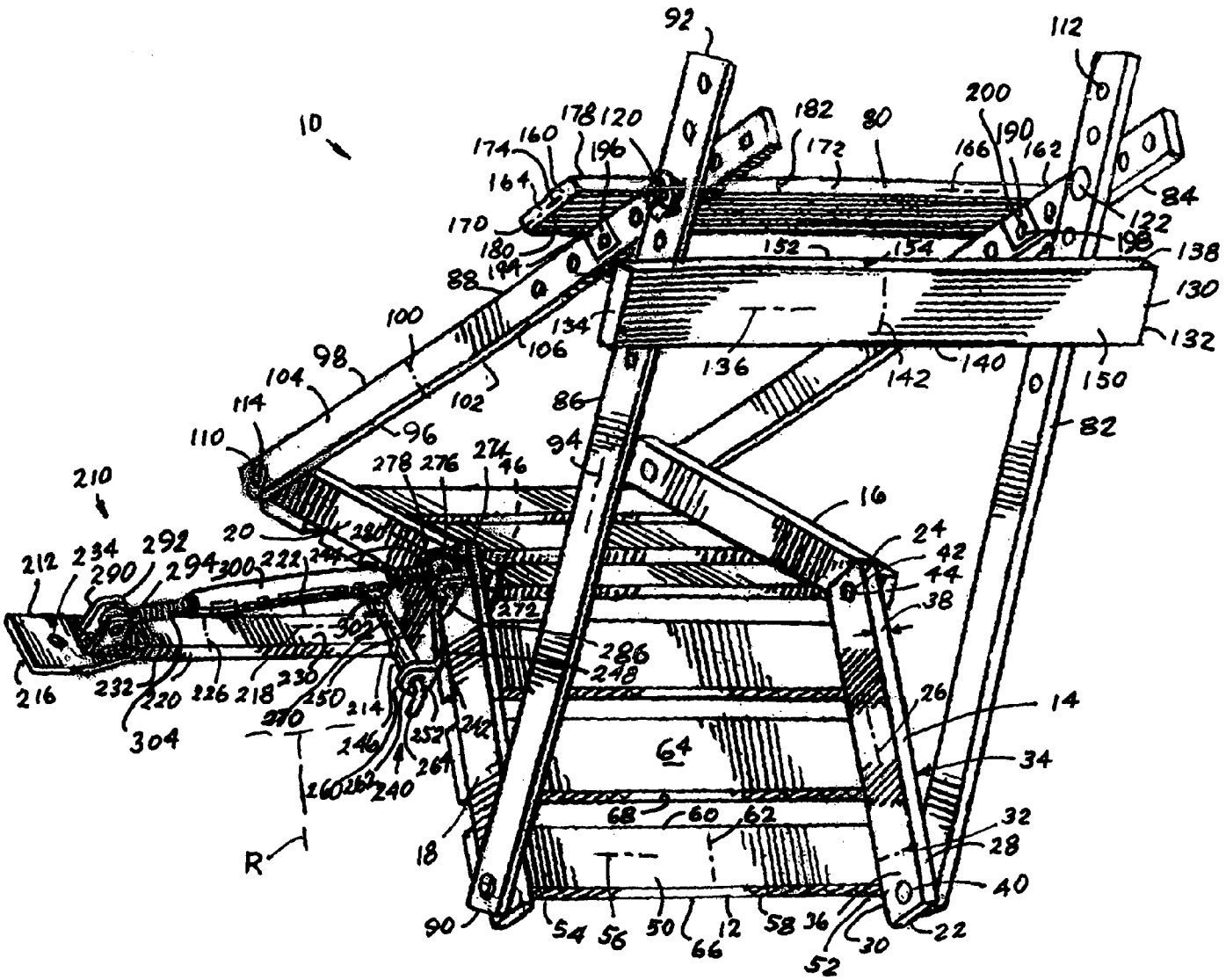

ROOF SCAFFOLD SUPPORT

BACKGROUND OF THE INVENTION

1. Field of the Invention

The present invention relates to the general art of scaffolding, and to the particular field of scaffolding supports that are adapted for use on a roof.

2. Discussion of the Related Art

Many construction jobs require a worker to work on the roof of a building. Often, the work requires equipment and materials to be supported on the roof as well. To this end, the art has several examples of devices that can support a worker on a roof. However, many of these devices are not as stable as possible, especially with regard to a hip roof.

In some instances, it would be beneficial to have scaffolding located adjacent to the work area to hold workers and/or materials. The inventor is not aware of any device that can securely support a scaffold on a hip roof.

Therefore, there is a need for a device that can securely support a scaffold on a roof, especially a hip roof.

Any job is always more efficient if it can be completed quickly and accurately. Therefore, any device that is used in a construction job should be amenable to easy assembly and disassembly to be most effective. However, since much of the construction equipment must be transported to a construction site, it will be most efficient if the equipment can be disassembled for storage and transport and then assembled as needed on the site.

Therefore, there is a need for a device that can securely support a scaffold on a roof and which is easy to assemble and disassemble, especially on site.

If a device is used in connection with a hip roof, it may have to be stabilized to be securely held in place. This may be difficult if the roof is complex and the work location is in a difficult to reach location. Therefore, to be most effective, any equipment so used should be as versatile as possible so the equipment is amenable to a wide range of uses.

Therefore, there is a need for a device that can securely support a scaffold on a hip roof and can be stabilized as necessary.

Furthermore, there is a need for a device that is versatile and is amenable to a wide range of uses.

PRINCIPAL OBJECTS OF THE INVENTION

It is a main object of the present invention to provide a device that can securely support a scaffold on a roof.

It is another object of the present invention to provide a device that can securely support a scaffold on a hip roof.

It is another object of the present invention to provide a device that can securely support a scaffold on a hip roof and can be stabilized as necessary.

It is another object of the present invention to provide a device that can securely support a scaffold on a roof and which is easy to assemble and disassemble.

It is another object of the present invention to provide a device that can securely support a scaffold on a roof and which is versatile and amenable to a wide range of heights and uses.

It is another object of the present invention to provide a device that can securely support a scaffold on a roof and which is easy to assemble and disassemble on site.

SUMMARY OF THE INVENTION

These, and other, objects are achieved by a scaffold support adapted for use on a roof which comprises a roof-engaging base unit having two sections and a pivot connection between the two sections; a scaffold-engaging unit having a plurality of legs each pivotally attached to the roof-engaging base unit and being releasably attached together in pairs, each leg having a plurality of fastener-accommodating holes defined therethrough and a fastener attaching one leg to an associated leg; two scaffold-engaging crossbar elements mounted on the legs of the scaffold-engaging unit; and a stabilizing unit releasably and pivotally attached to the roof-engaging base unit and including a turnbuckle adjusting element.

The device embodying the present invention is thus amenable to use on a wide variety of roofs, including hip roofs, and can be easily set up, dis-assembled and adjusted as needed. The device can be adjusted to varying heights and roof pitches as required for safe and efficient use and can be quickly and easily assembled on site.

BRIEF DESCRIPTION OF THE DRAWING FIGURES

The FIGURE is a perspective view of a scaffold support embodying the present invention.

DETAILED DESCRIPTION OF THE PREFERRED EMBODIMENT

Other objects, features and advantages of the invention will become apparent from a consideration of the following detailed description and the accompanying drawings.

Referring to the FIGURES, it can be understood that the present invention is embodied in a scaffold support 10 that is adapted for use on a roof R, such as a hip or common ridge roof. Support 10 is used in combination with a ladder or pump jacks or poles or the like to support planks of a scaffold above a roof. The planks can be wood or aluminum or the like. The scaffold is not supported fully by the poles and/or ladders and thus can be heavier than other scaffolds that must be fully supported by the poles and/or ladders. Device 10 can be used as a stage in a scaffold if desired as well.

Device 10 comprises a roof-engaging base unit 12 which includes a plurality of arms including first arm 14, second arm 16, third arm 18, and fourth arm 20. The arms are identical and each arm has a first end 22, a second end 24, and a longitudinal axis 26 which extends between the first end 22 and the second end 24. Each arm further includes a first side 28, a second side 30, and a transverse axis 32 which extends between the first side 28 and the second side 30. Each arm further includes a first surface 34, a second surface 36, and a thickness 38 which extends between the first surface 34 and the second surface 36.

A first pivot pin-accommodating hole 40 is defined through each arm adjacent to the first end 22, and a second pivot pin-accommodating hole 42 is defined through each arm adjacent to the second end 24.

A first pivot pin 44 extends through the second pivot pin-accommodating hole 42 in the first arm 14 and through the second pivot pin-accommodating hole 42 in the second arm 16 and pivotally connects the first arm 14 to the second arm 16 with the first surface 34 of the first arm 14 slidingly engaging the second surface 36 of the second arm 16 adjacent to the first end 22 of the first arm 14 and adjacent to the first end 22 of the second arm 16. The first arm 14 is pivotally movable with respect to the second arm 16 in the direction of the transverse axis 32 of the first arm 14. This permits the base unit 12 to be adapted to the slope of roof R.

A second pivot pin 46 extends through the second pivot pin-accommodating hole 42 in the third arm 18 and through the second pivot pin-accommodating hole 42 in the fourth arm 20 and pivotally connects the third arm 18 to the fourth arm 20 with the second surface 36 of the third arm 18 slidingly engaging the first surface 34 of the fourth arm 20 adjacent to the first end 22 of the third arm 18 and adjacent to the first end 22 of the fourth arm 20. The third arm 18 is pivotally movable with respect to the fourth arm 20 in the direction of the transverse axis 32 of the third arm 18.

A plurality of crossbrace elements, such as crossbrace element 50, connect the first arm 14 and third arm 18 together and connect the second arm 16 and fourth arm 20 together. The crossbrace elements 50 are identical and each crossbrace element includes a first end 52 fixed to the second side 30 of an associated arm, a second end 54 fixed to the second side 30 of another associated arm, and a longitudinal axis 56 which extends between the first end 52 of each crossbrace element 50 and the second end 54 of each crossbrace element 50. Each crossbrace element 50 further includes a first side 58, a second side 60 with the second side 60 of each crossbrace element 50 being spaced apart from the first side 58 of an adjacent crossbrace element 50, and a transverse axis 62 which extends between the first side 58 of each crossbrace element 50 and the second side 60 of each crossbrace element 50. Each crossbrace element 50 further includes a first surface 64 with the first surface 64 of each crossbrace element 50 being located adjacent to the second surface 36 of the associated arm, a second surface 66, and a thickness 68 which extends between the first surface 64 of each crossbrace element 50 and the second surface 66 of each crossbrace element 50.

A scaffold-engaging unit 80 includes a plurality of support arms 82, 84, 86 and 88. The support arms are identical to each other and each support arm has a first end 90, a second end 92, and a longitudinal axis 94 which extends between the first end 90 of each support arm and the second end 92 of each support arm. Each support arm further includes a first side 96, a second side 98, and a transverse axis 100 which extends between the first side 96 of each support arm and the second side 98 of each support arm. Each support arm further includes a first surface 102, a second surface 104, and a thickness 106 which extends between the first surface 102 of each support arm and the second surface 104 of each support arm.

A pivot pin-accommodating hole 110 is defined through each support arm adjacent to the first end 90 of each support arm, and a plurality of fastener-accommodating holes, such as fastener-accommodating hole 112, are defined through each support arm. The fastener-accommodating holes 112 are spaced apart from each other in the direction of the longitudinal axis 94 of each support arm with one fastener-accommodating hole 112 located adjacent to the second end 92 of each support arm.

A pivot pin 114 extending through the pivot pin-accommodating hole 110 defined in each support arm and through the first pivot pin-accommodating hole 40 defined in each arm of the roof-engaging base unit 12 and pivotally connects each support arm of the scaffold-engaging unit 80 to an associated arm of the roof-engaging base unit 12 with the second surface 104 of each support arm of the scaffold-engaging unit 80 slidably engaging the first surface 34 of the associated arm of the roof-engaging base unit 12.

A first fastener 120 extends through one of the fastener-accommodating holes 112 in a first support arm and through one of the fastener-engaging holes 112 in a second support arm and attaches the first support arm to the second support arm with the first surface 102 of the first support arm abutting the second surface 104 of the second support arm. A second fastener 122 extends through one of the fastener-accommodating holes 112 in a third support arm and through one of the fastener-engaging holes in a fourth support arm and attaches the third support arm to the fourth support arm with the second surface 104 of the third support arm abutting the first surface 102 of the fourth support arm. By selecting appropriate fastener-accommodating holes, the angle of the device 10 can be altered to fit the slope of the roof, and the height of the scaffold being supported above the roof can also be adjusted.

A first scaffold-engaging crossbar element 130 is mounted on the first sides 96 of the first and third support arms and includes a first end 132 located adjacent to the second surface 104 of the first support arm, a second end 134 located adjacent to the first surface 102 of the third support arm, and a longitudinal axis 136 which extends between the first end 132 of the first scaffold-engaging cross bar element 130 and the second end 134 of the first scaffold-engaging cross bar element 130.

The first crossbar element 130 further includes a first side 138, a second side 140, and a transverse axis 142 which extends between the first side 138 of said first scaffold-engaging cross bar element 130 and the second side 140 of said first scaffold-engaging cross bar element 130. The first crossbar element 130 further includes a first surface 150, a second surface 152 which abuttingly engages the first sides 96 of the first and third support arms, and a thickness 154 which extends between the first side 138 of the first scaffold-engaging cross bar element 130 and the second side 140 of the first scaffold-engaging cross bar element 130.

A second scaffold-engaging crossbar element 160 is mounted on the first sides 96 of the second and fourth support arms and includes a first end 162 located adjacent to the second surface 104 of the second support arm, a second end 164 located adjacent to the first surface 102 of the fourth support arm, and a longitudinal axis 166 which extends between the first end 162 of the second scaffold-engaging cross bar element 160 and the second end 164 of the second scaffold-engaging cross bar element 160.

The second scaffold-engaging crossbar element 160 further includes a first side 170, a second side 172, and a transverse axis 174 which extends between the first side 170 of the second scaffold-engaging cross bar element 160 and the second side 172 of the second scaffold-engaging cross bar element 160.

The second scaffold-engaging crossbar element 160 further includes a first surface 178, a second surface 180 which abuttingly engages the first sides 96 of the second and fourth support arms, and a thickness 182 which extends between the first side 170 of the second scaffold-engaging cross bar element 160 and the second side 172 of the second scaffold-engaging cross bar element 160.

A plurality of U-shaped bracket elements, such as element 190, are fixed to the second surfaces 152, 180 of each scaffold-engaging cross bar element 130, 160. Each bracket element 190 includes a bight section 194 fixed to an associated scaffold-engaging cross brace element and two legs, such as leg 196, which extend from the bight section 194. A fastener-accommodating hole, such as fastener-accommodating hole 198, is defined through each leg 196 of each bracket element 190. The fastener-accommodating holes 198 in each leg 196 of each bracket 190 is aligned with the fastener-accommodating hole 198 in the other leg 196 and both holes 198 are adapted to be aligned with one of the fastener-accommodating holes 112 in each support arm of the scaffold-engaging unit 80. A fastener 200 extends through the fastener-accommodating holes 198 in each bracket element 190 and through the one fastener-accommodating hole 112 in each support arm of the scaffold-engaging unit 80. The scaffold-engaging cross bar elements 130, 160 can be moved on the arms to adjust the height of the scaffold-engaging unit 80 with respect to the roof.

A stabilizing unit 210 is attached to the roof-engaging base unit 12 and is used to adjust the angle of device 10 with respect to the roof. If needed, the angle can be adjusted so the scaffold-engaging cross braces will be maintained level to ensure stability of the device 10.

Stabilizing unit 210 includes a base element 212 having a proximal end 214, a distal end 216, and a longitudinal axis 218 which extends between the proximal end 214 and the distal end 216. Base element 210 further includes a first side 220, a second side 222, and a transverse axis 226 which extends between the first side 220 of the base element 212 of the stabilizing unit 210 and the second side 222 of the base element 212 of the stabilizing unit 210. Base element 212 further includes a first surface 230, a second surface 232, and a mounting fastener-accommodating hole 234 defined through the base element 212 adjacent to the distal end 216 of the base element 212. The second surface 232 of the base element 212 of the stabilizing unit 210 is adapted to engage a surface of a roof when the stabilizing unit 210 is in use. A nail or other such fastener can be received through hole 234 to fix the stabilizing unit 210 to the roof, if suitable.

An attachment bracket unit 240 is located on the first end of the base unit 212 of the stabilizing unit 210. The bracket unit 240 is used to attach the stabilizing unit 210 to the roof-engaging base unit 12 when the stabilizing unit 210 is used. The stabilizing unit 210 can be omitted if it is not needed and will be removed using the bracket unit 240. Bracket unit 240 includes a triangular body 242 having an apex 244, a base 246, two sides 248, a first surface 250, and a second surface 252. The first surface 250 of the triangular body 242 is located adjacent to the first surface 230 of the base element 212 of the stabilizing unit 210.

A wing element 260 is located on each side adjacent to an intersection of each side 248 and the base 246. Each wing element 260 extends from the triangular body 242 toward the distal end 216 of the base element 212 of the stabilizing unit 210 in the direction of the longitudinal axis 218 of the base element 212 of the stabilizing unit 210 and has a fastener-accommodating hole 262 defined therethrough.

A pivot pin 264 extends through the holes 262 on each wing element 260 in the direction of the transverse axis 226 of the base element 212 of the stabilizing unit 210.

A sheath 270 surrounds the pivot pin 264 of the stabilizing unit 210. The sheath 270 is fixed to the proximal end 214 of the base element 212 of the stabilizing unit 210. The base element 212 of the stabilizing unit 210 is pivotally attached to the triangular body 242 via the pivot pin 264 and the sheath 270.

A U-shaped fastening bracket 272 is located on the apex 244 of the triangular body 242 and includes a bight portion 274 having a fastener-accommodating hole 276 defined therethrough, two legs, such as leg 278, and a fastener-accommodating hole 280 defined through each leg 278.

The second pivot pin 46 of the roof-engaging base unit 12 extends through the fastener-accommodating hole 276 of the U-shaped fastening bracket 272 on the apex 244 of the triangular body 242 and fixes the U-shaped fastening bracket 272 to the roof-engaging base unit 12.

A fastener 286 extends through the fastener-accommodating holes 280 defined in the legs 278 of the U-shaped fastening bracket 272.

A U-shaped mounting bracket 290 is located on the first surface 230 of the base element 212 of the stabilizing unit 210. Mounting bracket 290 is located adjacent to the distal end 216 of the base element 212 of the stabilizing unit 210 and includes two legs, such as leg 292, with each leg 292 having a fastener-accommodating hole 294 defined therethrough. The fastener-accommodating holes 294 in the mounting bracket 290 are aligned with each other.

A fastener 296 is rotatably mounted in the fastener-accommodating holes 294 in the U-shaped mounting bracket 290 on the first surface 230 of the base element 212 of the stabilizing unit 210 and extends in the direction of the transverse axis 226 of the base element 212 of the stabilizing unit 210.

A turnbuckle element 300 has a first end 302 attached to the fastener 286 extending through the fastener-accommodating holes 280 defined in the legs 278 of the U-shaped fastening bracket 272 and a second end 304 attached to the fastener 296 rotatably mounted in the fastener-accommodating holes 294 in the U-shaped mounting bracket 290 on the first surface 230 of the base element 212 of the stabilizing unit 210.

As can be understood from the foregoing, by adjusting the relative angles between elements of device 10, by adjusting the turnbuckle 300 and by adjusting the position of the scaffold-engaging cross arms, the position of a scaffold with respect to the roof can be adjusted to any suitable degree. Device 10 is easily set up and disassembled and can work in combination with other support devices to securely hold a scaffold in place on a roof.

It is understood that while certain forms of the present invention have been illustrated and described herein, it is not to be limited to the specific forms or arrangements of parts described and shown.

What is claimed and desired to be covered by Letters Patent is:

1. A scaffold support adapted for use on a roof comprising:

a) a roof-engaging base unit which includes
  (1) a plurality of arms, each arm having
    (A) a first end,
    (B) a second end,
    (C) a longitudinal axis extending between the first end and the second end,
    (D) a first side,
    (E) a second side,
    (F) a transverse axis extending between the first side and the second side,
    (G) a first surface,
    (H) a second surface,
    (I) a thickness extending between the first side and the second side,
    (J) a first pivot pin-accommodating hole defined therethrough adjacent to the first end, and
    (K) a second pivot pin-accommodating hole defined therethrough adjacent to the second end;
  (2) a first pivot pin extending through the second pivot pin-accommodating hole in a first arm and through the second pivot pin-accommodating hole in a second arm and pivotally connecting the first arm to the second arm with the first surface of the first arm slidingly engaging the second surface of the second arm adjacent to the first end of the first arm and adjacent to the first end of the second arm, the first arm being pivotally movable with respect to the second arm in the direction of the transverse axis of the first arm, (3) a second pivot pin extending through the second pivot-pin accommodating hole in a third arm and through the second pivot pin-accommodating hole in a fourth arm and pivotally connecting the third arm to the fourth arm with the second surface of the third arm slidingly engaging the first surface of the fourth arm adjacent to the first end of the third arm and adjacent to the first end of the fourth arm, the third arm being pivotally movable with respect to the fourth arm in the direction of the transverse axis of the third arm, and (4) a plurality of crossbrace elements connecting the first and third arms together and connecting the second and fourth arms together, each crossbrace element including;

(A) a first end fixed to the second side of an associated arm, (B) a second end fixed to the second side of another associated arm, (C) a longitudinal axis extending between the first end of each crossbrace element and the second end of each crossbrace element, (D) a first side, (E) a second side, the second side of each crossbrace element being spaced apart from the first side of an adjacent crossbrace element, (F) a transverse axis extending between the first side of each crossbrace element and the second side of each crossbrace element, (G) a first surface, the first surface of each crossbrace element being located adjacent to the second surface of the associated arm, (H) a second surface, and (I) a thickness which extends between the first surface of each crossbrace element and the second surface of each crossbrace element;

b) a scaffold-engaging unit which includes (1) a plurality of support arms, each support arm having (A) a first end, (B) a second end, (C) a longitudinal axis extending between the first end of each support arm and the second end of each support arm, (D) a first side, (E) a second side, (F) a transverse axis extending between the first side of each support arm and the second side of each support arm, (G) a first surface, (H) a second surface, (I) a thickness extending between the first surface of each support arm and the second surface of each support arm, (J) a pivot pin-accommodating hole defined through each support arm adjacent to the first end of each support arm, and (K) a plurality of fastener-accommodating holes defined through each support arm, the fastener-accommodating holes being spaced apart from each other in the direction of the longitudinal axis of each support arm, one fastener-accommodating hole being located adjacent to the second end of each support arm, (2) a pivot pin extending through the pivot pin-accommodating hole defined in each support arm and through the first pivot pin-accommodating hole defined in each arm of said roof-engaging base unit and pivotally connecting each support arm of said scaffold-engaging unit to an associated arm of said roof-engaging base unit with the second surface of each support arm of said scaffold-engaging unit slidably engaging the first surface of the associated arm of said roof-engaging base unit, (3) a first fastener extending through one of the fastener-accommodating holes in a first support arm and through one of the fastener-engaging holes in a second support arm and attaching the first support arm to the second support arm with the first surface of the first support arm abutting the second surface of the second support arm, and (4) a second fastener extending through one of the fastener-accommodating holes in a third support arm and through one of the fastener-engaging holes in a fourth support arm and attaching the third support arm to the fourth support arm with the second surface of the third support arm abutting the first surface of the fourth support arm;

c) a first scaffold-engaging crossbar element mounted on the first sides of the first and third support arms and including (1) a first end located adjacent to the second surface of the first support arm, (2) a second end located adjacent to the first surface of the third support arm, (3) a longitudinal axis extending between the first end of said first scaffold-engaging cross bar element and the second end of said first scaffold-engaging cross bar element, (4) a first side, (5) a second side, (6) a transverse axis extending between the first side of said first scaffold-engaging cross bar element and the second side of said first scaffold-engaging cross bar element, (7) a first surface, (8) a second surface which abuttingly engages the first sides of the first and third support arms, and (9) a thickness extending between the first side of said first scaffold-engaging cross bar element and the second side of said first scaffold-engaging cross bar element;

d) a second scaffold-engaging crossbar element mounted on the first sides of the second and fourth support arms and including (1) a first end located adjacent to the second surface of the second support arm, (2) a second end located adjacent to the first surface of the fourth support arm, (3) a longitudinal axis extending between the first end of said second scaffold-engaging cross bar element and the second end of said second scaffold-engaging cross bar element, (4) a first side, (5) a second side, (6) a transverse axis extending between the fist side of said second scaffold-engaging cross bar element and the second side of said second scaffold-engaging cross bar element, (7) a first surface, (8) a second surface which abuttingly engages the first sides of the second and fourth support arms, and (9) a thickness extending between the first side of said second scaffold-engaging cross bar element and the second side of said second scaffold-engaging cross bar element;

e) a plurality of U-shaped bracket elements fixed to the second surface of each scaffold-engaging cross bar element, each U-shaped bracket element including (1) a bight section fixed to an associated scaffold-engaging cross brace element, (2) two legs extending from the bight section, (3) a fastener-accommodating hole defined through each leg of each U-shaped bracket element, the fastener-accommodating holes in each leg of each U-shaped bracket element being aligned with each other and adapted to be aligned with one of the fastener-accommodating holes in each support arm of said scaffold-engaging unit, and (4) a fastener extending through the fastener-accommodating holes in each U-shaped bracket element and through the one fastener-accommodating hole in each support arm of said scaffold-engaging unit; and f) a stabilizing unit attached to said roof-engaging base unit and including (1) a base element having a proximal end, a distal end, a longitudinal axis extending between the proximal end and the distal end, a first side, a second side, a transverse axis extending between the first side of the base element of said stabilizing unit and the second side of the base element of said stabilizing unit, a first surface, a second surface, and a mounting fastener-accommodating hole defined through the base element adjacent to the distal end of the base element, the second surface of the base element of said stabilizing unit being adapted to engage a surface of a roof when said stabilizing unit is in use, (2) an attachment bracket unit on the first end of the base unit of said stabilizing unit, the attachment bracket unit having (A) a triangular body having an apex, a base, two sides, a first surface, a second surface, the first surface of the triangular body being located adjacent to the first surface of the base element of said stabilizing unit, (B) a wing element on each side adjacent to an intersection of each side and the base, each wing element extending from the triangular body towards the distal end of the base element of said stabilizing unit in the direction of the longitudinal axis of the base element of said stabilizing unit and having a fastener-accommodating hole defined therethrough, (C) a pivot pin extending through the holes on each wing element in the direction of the transverse axis of the base element of said stabilizing unit, (D) a sheath surrounding the pivot pin of said stabilizing unit, the sheath being fixed to the proximal end of the base element of said stabilizing unit, the base element of said stabilizing unit being pivotally attached to the triangular body via the pivot pin and the sheath, (E) a U-shaped fastening bracket on the apex of the triangular body and including a bight portion having a fastener-accommodating hole defined therethrough, two legs, a fastener-accommodating hole defined through each leg, (F) the second pivot pin of said roof-engaging base unit extending through the fastener-accommodating hole of the U-shaped fastening bracket on the apex of the triangular body and fixing the U-shaped fastening bracket to said roof-engaging base unit, (G) a fastener extending through the fastener-accommodating holes defined in the legs of the U-shaped fastening bracket, (3) a U-shaped mounting bracket on the first surface of the base element of said stabilizing unit, the mounting bracket being located adjacent to the distal end of the base element of said stabilizing unit and including two legs with each leg having a fastener-accommodating hole defined therethrough, the fastener-accommodating holes in the mounting bracket being aligned with each other, (4) a fastener rotatably mounted in the fastener-accommodating holes in the U-shaped mounting bracket on the first surface of the base element of said stabilizing unit and extending in the direction of the transverse axis of the base element of said stabilizing unit, and (5) a turnbuckle element having a first end attached to the fastener extending through the fastener-accommodating holes defined in the legs of the U-shaped fastening bracket and a second end attached to the fastener rotatably mounted in the fastener-accommodating holes in the U-shaped mounting bracket on the first surface of the base element of said stabilizing unit.

* * * * *